United States Patent [19]

Hough

[11] 3,974,564

[45] Aug. 17, 1976

[54] SURFACE HARDENED STEEL CUTTING BLADE

[75] Inventor: John A. Hough, Auckland, New Zealand

[73] Assignee: Tullen Industries Limited, Auckland, New Zealand

[22] Filed: Dec. 29, 1972

[21] Appl. No.: 319,387

[30] Foreign Application Priority Data

Nov. 23, 1972 New Zealand ..... 169095

[52] U.S. Cl. ..... 30/350; 76/104 A

[51] Int. Cl.[2] ..... B26B 13/00; B21K 11/06

[58] Field of Search ..... 30/350; 76/104

[56] References Cited

UNITED STATES PATENTS

| | | | |
|---|---|---|---|
| 1,792,505 | 2/1931 | Noble | 30/350 |
| 2,361,554 | 10/1944 | Lundbye | 30/350 X |
| 2,371,600 | 3/1945 | Bartholomew | 30/350 X |
| 3,193,926 | 7/1965 | Honiss | 30/350 |

FOREIGN PATENTS OR APPLICATIONS

| | | | |
|---|---|---|---|
| 651,708 | 10/1937 | Germany | 30/350 |

*Primary Examiner*—Al Lawrence Smith
*Assistant Examiner*—J. C. Peters
*Attorney, Agent, or Firm*—Holman & Stern

[57] ABSTRACT

A surface hardened steel cutting blade adapted to be used in shear against another hardened blade has chipping eliminated or reduced substantially by limiting the hardened layer of the inner face of the blade to 0.002 to 0.008 inches thick, backed by a softer layer which is exposed at the edge face adjacent the cutting edge.

7 Claims, 4 Drawing Figures

SURFACE HARDENED STEEL CUTTING BLADE

BACKGROUND OF THE INVENTION

This invention relates to an improved surface hardened steel cutting blade which is adapted to be used in a shearing manner against another blade. Where both blades are hardened, problems occur with chipping on the return stroke since the two hardened cutting edges of the blades tend to lift or chip portions of the surface hardening out of the other blade as they pass.

SUMMARY OF THE INVENTION

The object of the invention is to eliminate or at least largely reduce the problem of chipping of the hardened case and to achieve this, the invention provides a surface hardened steel shearing blade having a inner face with a hardened surface of from 0.002 to 0.008 inch thick, backed by a softer layer which is exposed at the edge face adjacent the cutting edge.

BRIEF DESCRIPTION OF THE DRAWINGS

The invention will be described with reference to the accompanying drawings in which.

DETAILED DESCRIPTION OF THE PREFERRED EMBODIMENT

Figure 4:
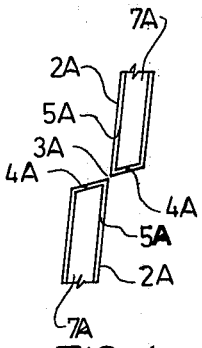
FIG. 4 shows a partial cross section through a prior art shear blade hardened after grinding.

In the drawings, the blade 1 has a hardened surface 2 and a cutting edge 3. There are various ways of providing the cutting edge. For example, in FIG. 4, the cutting edge 3A is formed by the intersection of the inner face 2A and edge face 4A, the edge face being shaped by grinding or otherwise prior to a case hardening process. There is therefore a hardened layer 5A encasing the blade and it has been found that the cutting edge 3A tends to chip away, especially on the return stroke of the blades and thus renders the blades relatively ineffective and harsh in operation.

Figure 1:
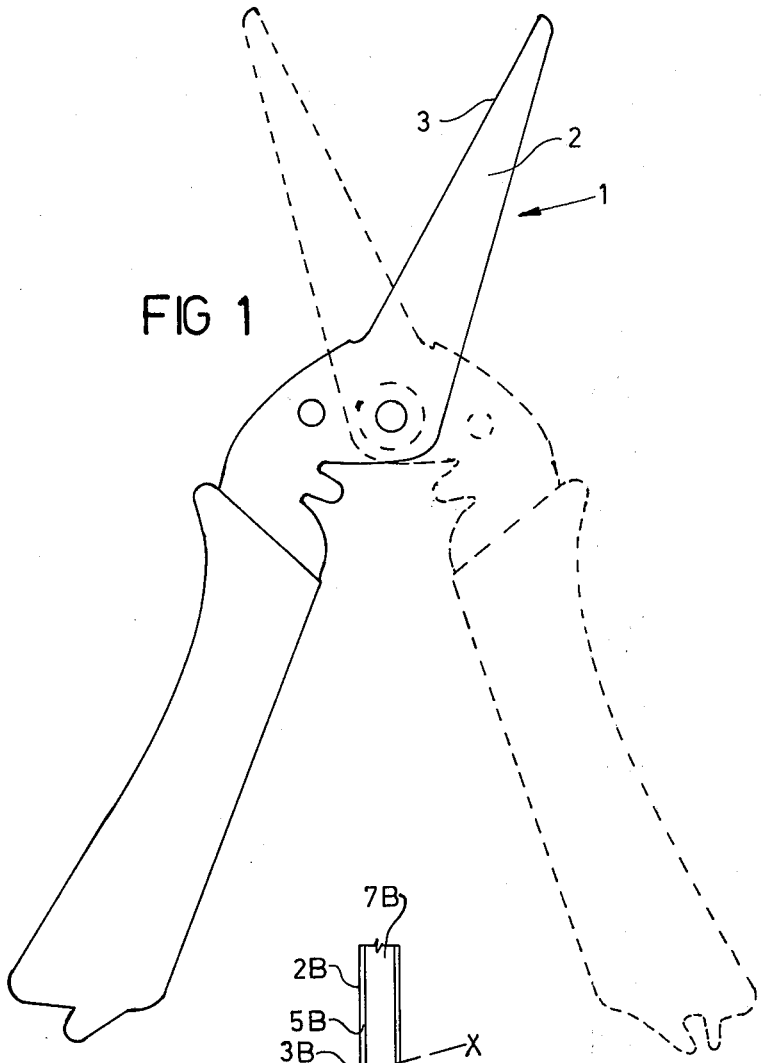
FIG. 1 shows an elevation of a typical cutting blade for a pair of shears (an overlapping blade being dotted in)
Figure 3:
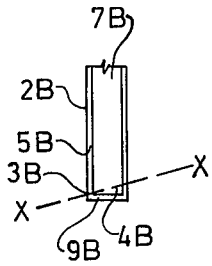
FIG. 3 shows a partial cross section through a hardened shear blade prior to grinding.

As FIG. 3 shows, the problem may be at least partially overcome by grinding away the edge 9B to remove the hardened case 5B in that region, the cutting edge 3B being formed at the intersection of the inner face 2B and a new edge face 4B formed along the line X —X during the grinding process.

Figure 2:
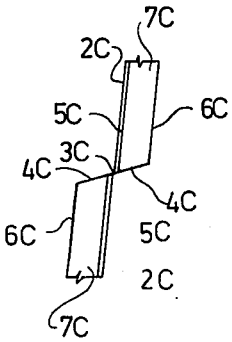
FIG. 2 shows a partial cross section through two shear blades at the point of contact.

As FIG. 2 shows, it is also possible to arrange the hardening process so that only the inner face surface 2C is hardened, perhaps together with the rear face 6C. The hardened case 5C is an area which is rich in carbon, the carbon having been inserted by laminating a carbon rich layer during a rolling process to a base of lower carbon content or by suitably introducing carbon by a step in a case hardening process. This has the effect of the construction shown in FIG. 3 of eliminating the hardened surface along the edge face 4C. However, it has been found that with both of the constructions shown in FIGS. 2 and 3, the thickness of the hardened skin 5 is relatively critical. The precise thickness will vary with the hardness achieved and also with the difference in hardness between the layer 5 and the core 7. According to this invention the thickness of hardened layer 5 is from 0.002 to 0.008 inches when the hardness exceeds 60 Rockwell C but is preferably less than 75 Rockwell C and this is suitable where the core 7 has a hardness of up to 50 Rockwell C, preferably from 10–50 Rockwell C. In both cases the base material of the blade is mild steel, having an analysis of about Fe, 99 percent — Mn, 0.4 percent — C, 0.12 percent — other elements, 0.48 percent — all percentages being by weight. A preferred thickness is 0.005 to 0.006 inches.

The result of the invention is to provide a shear blade where chipping is eliminated or at least substantially reduced during cutting and return strokes.

What I claim is:

1. A shear type cutting tool comprising a pair of interconnected shearing blades for reciprocation between an open and closed state the latter of which completes a shearing action of the tool, each one of said blades having an inner face and an edge face the intersection of which defines a cutting edge thereof, the inner face being that face of a respective one of said blades lying closest to the other during the closed state of said reciprocating shearing blades and having a hardened surface of from 0.002 to 0.008 inches thick, backed by a softer layer which is exposed at said edge face adjacent the cutting edge of each of said blades.

2. A tool as claimed in claim 1 wherein the hardened surface is from 0.005 to 0.006 inches thick.

3. A tool as claimed in claim 1 wherein the hardened surface is above 60 Rockwell C.

4. A tool as claimed in claim 1 wherein the hardened surface is between 60–75 Rockwell C.

5. A tool as claimed in claim 3 wherein the hardness of the layer adjacent the hardened surface is below 50 Rockwell C.

6. A tool as claimed in claim 3 wherein the hardness of the layer adjacent the hardened surface is from 10 – 50 Rockwell C.

7. A shear type cutting tool comprising a pair of interconnected shearing blades for reciprocation between an open and closed state the latter of which completes a shearing action of the tool, each one of said blades having an inner face and an edge face the intersection of which defines a cutting edge thereof, the inner face being that face of a respective one of said blades which lies closest to the other blade during the closed state of said reciprocating shearing blades and having a hardened surface of from 0.002 to 0.008 inches thick and a hardness between 60 and 75 Rockwell C and a layer adjacent the hardened surface having a hardness of between 10–50 Rockwell C and exposed at said edge face adjacent the cutting edge of each of said blades.

* * * * *